US010611529B2

(12) United States Patent
Wada

(10) Patent No.: US 10,611,529 B2
(45) Date of Patent: Apr. 7, 2020

(54) LIDDED CONTAINER

(71) Applicant: TOPPAN PRINTING CO., LTD., Tokyo (JP)

(72) Inventor: Kiyoshi Wada, Tokyo (JP)

(73) Assignee: TOPPAN PRINTING CO., LTD., Tokyo (JP)

( * ) Notice: Subject to any disclaimer, the term of this patent is extended or adjusted under 35 U.S.C. 154(b) by 67 days.

(21) Appl. No.: 15/702,688

(22) Filed: Sep. 12, 2017

(65) Prior Publication Data

US 2018/0002076 A1 Jan. 4, 2018

Related U.S. Application Data

(63) Continuation of application No. PCT/JP2016/001208, filed on Mar. 4, 2016.

(30) Foreign Application Priority Data

Mar. 26, 2015 (JP) ..... 2015-064988

(51) Int. Cl.
*B65D 43/22* (2006.01)
*B65D 43/16* (2006.01)

(52) U.S. Cl.
CPC ..... *B65D 43/163* (2013.01); *B65D 43/162* (2013.01); *B65D 43/22* (2013.01);
(Continued)

(58) Field of Classification Search
CPC .... B65D 43/163; B65D 43/162; B65D 43/22; B65D 2543/00092; B65D 2543/00296;
(Continued)

(56) References Cited

U.S. PATENT DOCUMENTS 4,334,631 A * 6/1982 Ballester ..... B65D 43/0206 206/508
4,397,404 A * 8/1983 Blanchette ..... B65D 21/022 206/508

(Continued)

FOREIGN PATENT DOCUMENTS

GB 2 240 322 A 7/1991
JP 11-263359 A 9/1999

(Continued)

OTHER PUBLICATIONS

International Search Report for International Patent Application No. PCT/JP2016/001208 dated May 31, 2016.

(Continued)

*Primary Examiner* — J. Gregory Pickett
*Assistant Examiner* — Niki M Eloshway
(74) *Attorney, Agent, or Firm* — Foley & Lardner LLP

(57) ABSTRACT

In a container having a lid member coupled to a container body by a hinge, the lid member includes a top surface, an inner ring formed on the top surface, and a projected part is formed on the top surface concentrically with the inner ring and which has an outer peripheral surface provided with an outer peripheral surface projection along the circumferential direction. The container body has a sidewall with a first inner peripheral surface having an inner peripheral surface projection formed along the circumferential direction, and a second inner peripheral surface having an inner diameter different from that of the first inner peripheral surface. When the lid member is closed, the inner ring seals the container body by being fitted to the second inner peripheral surface. The outer peripheral surface projection contacts and slides over the inner peripheral surface projection to lock the lid member the container body.

6 Claims, 5 Drawing Sheets

(52) U.S. Cl.
CPC ..... *B65D 2543/0049* (2013.01); *B65D 2543/00092* (2013.01); *B65D 2543/00296* (2013.01); *B65D 2543/00518* (2013.01); *B65D 2543/00537* (2013.01); *B65D 2543/00546* (2013.01); *B65D 2543/00555* (2013.01); *B65D 2543/00629* (2013.01); *B65D 2543/00685* (2013.01); *B65D 2543/00796* (2013.01); *B65D 2543/00842* (2013.01)

(58) Field of Classification Search
CPC ..... B65D 2543/00459; B65D 2543/00578; B65D 2543/00537; B65D 2543/00546; B65D 2543/00555; B65D 2543/00629; B65D 2543/00796; B65D 2543/00842
USPC ..... 220/839, 834, 837
See application file for complete search history.

(56) References Cited

U.S. PATENT DOCUMENTS 4,524,882 A * 6/1985 Buc ..... B44D 3/127 220/783
5,975,346 A * 11/1999 Imperato ..... B44D 3/123 220/284
6,240,930 B1 6/2001 Yuhara
6,401,957 B1 * 6/2002 Przytulla ..... B65D 43/0218 220/319
6,491,185 B1 * 12/2002 Azzarello ..... B65D 43/0206 206/508
8,322,565 B2 * 12/2012 Caulfield ..... B65D 43/162 220/780
10,246,227 B2 * 4/2019 Wada ..... B65D 45/32
2007/0084735 A1 * 4/2007 Lancesseur ..... B65D 43/164 206/204
2011/0089187 A1 * 4/2011 Steiger ..... B65D 43/162 220/839
2013/0256329 A1 * 10/2013 Belfance ..... B65D 43/162 220/833
2014/0312046 A1 * 10/2014 Yang ..... B65D 43/0254 220/792
2016/0060001 A1 * 3/2016 Wada ..... B65D 43/162 220/810

FOREIGN PATENT DOCUMENTS

JP 2000-236937 A 9/2000
JP 2008-297010 A 12/2008

OTHER PUBLICATIONS

Chinese Office Action dated Aug. 3, 2018 in corresponding application No. 2016800130642.

* cited by examiner

LIDDED CONTAINER

CROSS-REFERENCE TO RELATED PATENT APPLICATIONS

This application is a continuation application filed under 35 U.S.C. § 111(a) claiming the benefit under 35 U.S.C. §§ 120 and 365(c) of International Application No. PCT/JP2016/001208, filed on Mar. 4, 2016, which is based upon and claims the benefit of priority of Japanese Patent Application No. 2015-064988, filed on Mar. 26, 2015, the entireties of which are hereby incorporated by reference.

TECHNICAL FIELD

The present invention relates to a container that includes a container body and a lid member that seals an opening portion of the container body.

BACKGROUND

There is known a container that includes a lid member coupled to a container body by a hinge so as to be openable/closable relative to an opening portion of the container body. FIG. 5 shows a cross section of such a container 900. In the container 900, a lid member 911 is closed in such a way that a sidewall 922 and an inner ring 912 provided to the lid member 911 sandwich an opening portion of a container body 901. At this time, in order to enhance sealing properties, the inner ring 912 is fitted to an inner peripheral surface of the opening portion of a sidewall 902 of the container body 901. The sidewall 922 of the lid member 911 has an inner peripheral surface on which a projection 914 is formed along the circumferential direction. The sidewall 902 of the container body 901 has an outer peripheral surface on which a recess 903 is formed along the circumferential direction. In the state where the lid member is closed, the projection 914 and the recess 903 are engaged with each other to lock the lid member 911 so as not to be opened.

PRIOR ART LITERATURE

Citation List

[Patent Literature]
[PTL 1] JP 2008-297010 A

SUMMARY OF THE INVENTION

Technical Problem

In such a container, when closing the lid member, the projection slides over the opening portion of the container body. In this case, the sidewall of the lid member receives resistance from the opening portion, which results in displacement and expansion of the sidewall radially outward. In conformity with this displacement, the inner ring is also displaced and expands radially outward. Thus, a large force is needed for closing the lid member, because the inner ring has to be strongly pressed against the inner wall of the opening portion when the inner ring is fitted to an inner wall. Further, since the sidewall is provided to a lid member, the outer diameter of the lid member is increased accordingly, which may lead to degradation of the design. Additionally, since the sidewall and the inner ring of the lid member sandwich the container body, closing the lid member narrows the path for the air to escape and raises the inner pressure. Consequently, the lid tends to float in a closed state, which may lead to insufficient sealing of the container, or opening of the lid when not desired.

An object of the present invention is to provide a container that has a lid member coupled to a container body by a hinge, the container enabling easier and reliable closing operation of the lid member while improving the design.

Solution to Problem

An aspect of the present invention is a container that includes a cylindrical container body, and a lid member coupled to the container body by a hinge so as to be openable/closable relative to an opening portion of the container body. The lid member includes a top surface, and an inner ring formed on the top surface, and a projected part which is formed on the top surface concentrically with the inner ring and which has an outer peripheral surface provided with an outer peripheral surface projection along a circumferential direction. The container body has a sidewall provided with a first inner peripheral surface having an inner peripheral surface projection formed along the circumferential direction, and a second inner peripheral surface having an inner diameter different from that of the first inner peripheral surface. When the lid member is in a closed state, the inner ring seals the container body by being fitted to the second inner peripheral surface of the container body. When closing the lid member, the outer peripheral surface projection of the projected part contacts and slides over the inner peripheral surface projection of the first inner peripheral surface, to cause the lid member to be locked to the container body, with the inner ring sealing the container body.

When closing the lid member, the projected part contacts and slides over a part of the first inner peripheral surface, the projected part being a part where the inner diameter becomes large, and then an end of the inner ring causes the inner ring to seal the container body.

The lid member and the end portion of the sidewall of the container body may have the same outer diameter, and in a closed state, the top surface of the lid member may come in contact with the end portion of the sidewall of the container body.

The lid member may have a peripheral edge portion facing a portion where the lid member is coupled to the hinge, the peripheral edge portion being formed with a flange having an upper flush with an upper surface of the top surface of the lid member.

Advantageous Effects of the Invention

In the container of the present invention having the lid member coupled to the container body by a hinge, closing operation of the lid member can be carried out more easily and reliably, while improving the design.

BRIEF DESCRIPTION OF THE DRAWINGS

FIGS. 2A-2B are a set of diagrams in which FIG. 2A is a partial enlarged cross section of a container according to an embodiment of the present invention, and FIG. 2B is a partial enlarged cross section of a container according to a modification of the present invention.

DESCRIPTION OF REPRESENTATIVE EMBODIMENTS

Figure 1:
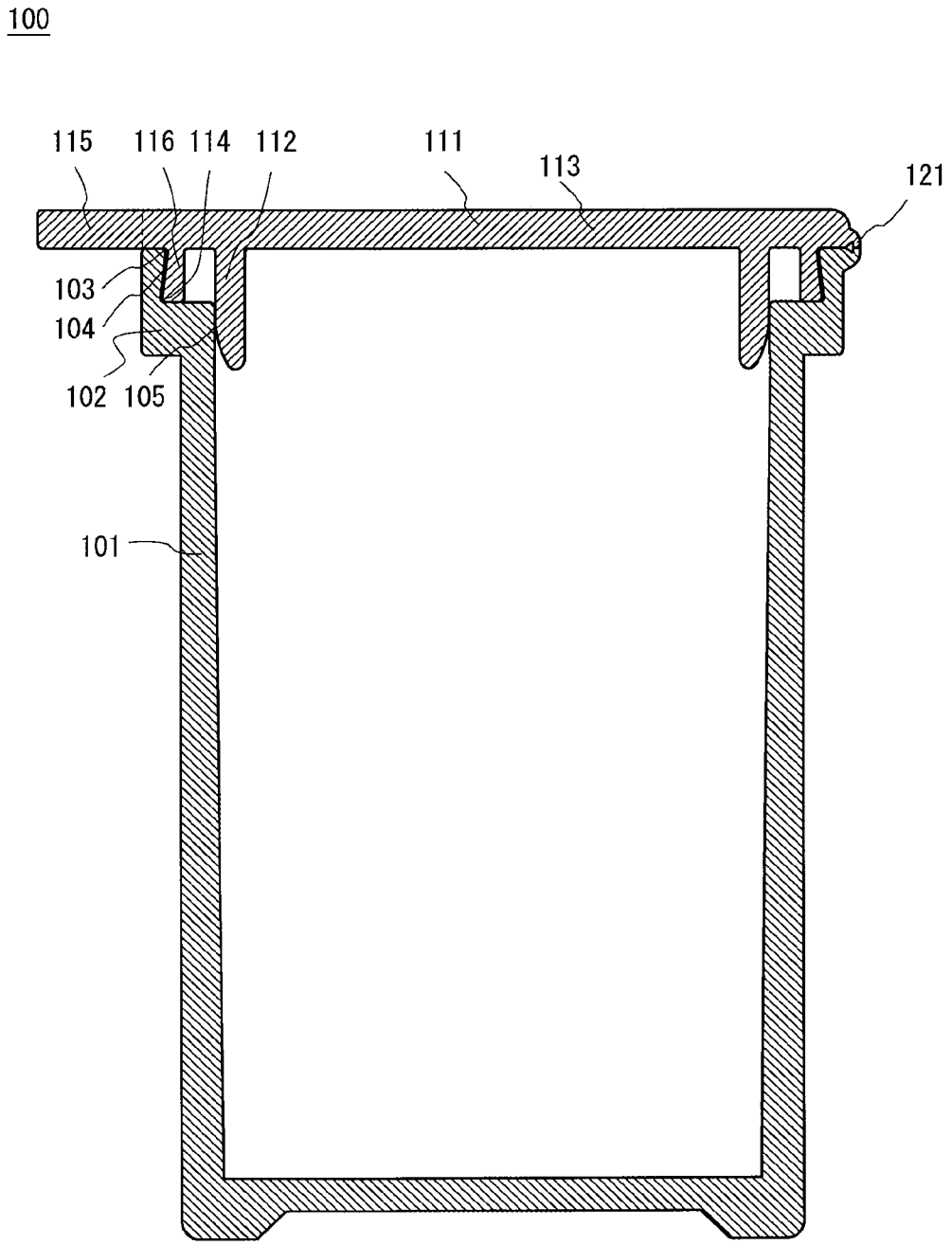
FIG. 1 is a cross section of a container according to an embodiment of the present invention.
Figure 2A:
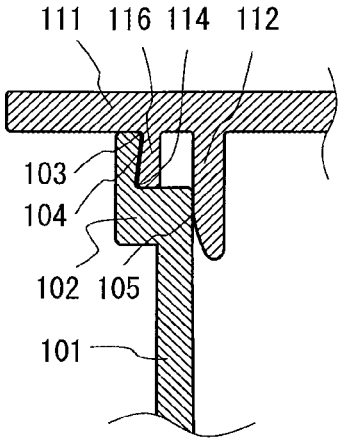

A container 100 according to an embodiment of the present invention will be described. The container 100 includes a cylindrical container body 101 having a sidewall 102, and a lid member 111. The container body 101 and the lid member 111 are coupled to each other by a hinge 121. FIG. 1 is a longitudinal cross section of the container 100 in a state where the lid member 111 is closed, taken by a plane that passes through a central axis of the container body 101 and the hinge 121. FIG. 2A is a partial enlarged view of the longitudinal cross section shown in FIG. 1.

The lid member 111 has a top surface 113, an inner ring 112 and a projected part 116. The inner ring 112 and the projected part 116 are formed on the top surface 113. The projected part 116 is formed concentrically with the inner ring 112 and has outer peripheral surface which is provided with an outer peripheral surface projection 114 along the circumferential direction.

The sidewall 102 of the container body 101 has a first inner peripheral surface 104 and a second inner peripheral surface 105, each with different inner diameters. The first inner peripheral surface 104 has an inner peripheral surface projection 103 formed along the circumferential direction, being projected inward.

In the closed state of the lid member 111, the inner ring 112 seals the container body 101 by being fitted to the second inner peripheral surface 105 of the container body 101. When closing the lid member 111, the outer peripheral surface projection 114 of the projected part 116 comes into contact with and slides over the inner peripheral surface projection 103 of the first inner peripheral surface 104 to thereby lock the lid member 111 to the container body 101 in a state where the inner ring 112 seals the container body 101.

The lid member 111 has a peripheral edge portion which faces a portion where the lid member 111 is coupled to the hinge 121. The peripheral edge portion is formed with a flange 115. The flange 115 and the top surface 113 are preferably shaped such that the respective upper surfaces are flush with each other to provide a planar surface.

Figure 2B:
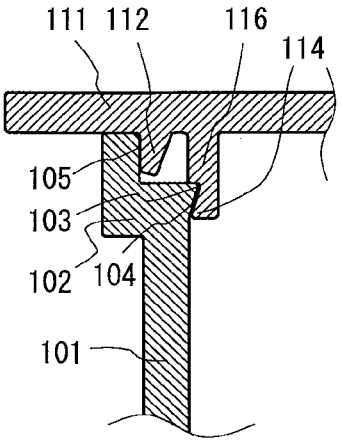

In the example shown in FIG. 2A, the projected part 116 is formed on the outside of the inner ring 112, and the inner diameter of the first inner peripheral surface 104 is larger than the inner diameter of the second inner peripheral surface 105. In another example shown in FIG. 2B, the projected part 116 is formed on the outside of the inner ring 112, and the inner diameter of the first inner peripheral surface 104 is smaller than the inner diameter of the second inner peripheral surface 105. In this way, the positions and the shapes of the inner ring 112, the projected part 116, the first inner peripheral surface 104, and the second inner peripheral surface 105 can be varied.

The projected part 116 or the outer peripheral surface projection 114 may be formed throughout the perimeter so as to be concentric with the inner ring, or may be partially formed along the circumferential direction. To secure strength, a plurality of ribs may be formed on the top surface 113 so as to radially extend from the center.

An example of how the lid member 111 is opened/closed will hereinafter be described. FIGS. 3A-3D show a set of cross sections in the vicinity of the flange 115 of the container 100 in the process of opening/closing the lid member 111 shown in FIG. 2A. FIGS. 4A-4D show a set of cross sections in the vicinity of the flange 115 of the container 100 in the process of opening/closing the lid member 111 shown in FIG. 2B.

Figure 3A:
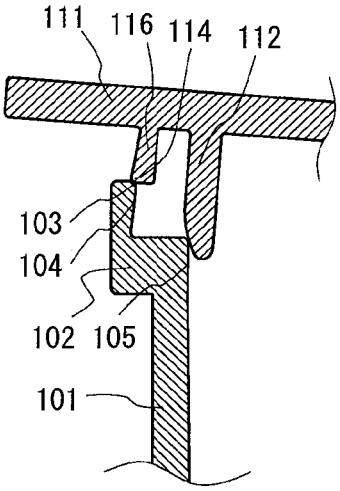
FIGS. 3A-3D are a set of diagrams in which FIGS. 3A, 3B, 3C, and 3D each show partial enlarged cross sections of a container according to an embodiment of the present invention.
Figure 4A:
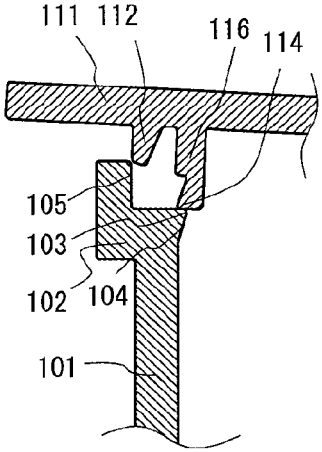
FIGS. 4A-4D are a set of diagrams in which FIGS. 4A, 4B, 4C, and 4D each show a partial enlarged cross section of a container according to an embodiment of the present invention.

When closing the lid member 111 from its opened state using the hinge 121 as an axis, the outer peripheral surface projection 114 of the projected part 116 first comes into contact with the inner peripheral surface projection 103 of the first inner peripheral surface 104 as shown in FIG. 3A or FIG. 4A. Moreover, the inner ring 112 comes into contact with the second inner peripheral surface 105. Either of these contacts may occur first, or these contacts may occur at the same time.

Figure 3B:
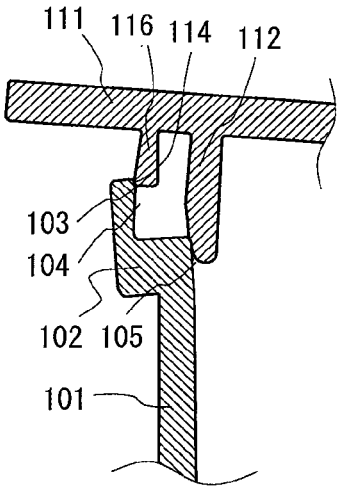
Figure 3C:
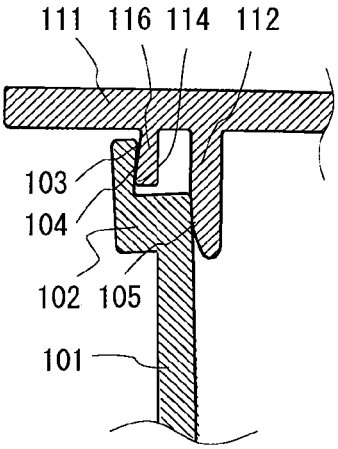
Figure 4B:
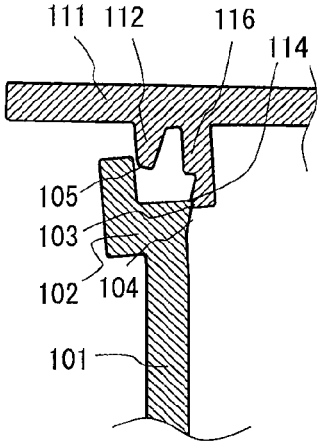
Figure 4C:
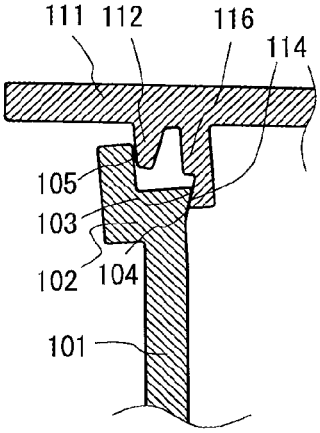

Afterwards, as shown in FIG. 3B or FIG. 4B, the sidewall 102 elastically deforms radially outward, and the projected part 116 and the inner ring 112 elastically deform radially inward. Further, as shown in FIG. 3C or FIG. 4C, the outer peripheral surface projection 114 comes into contact with and slides over the inner peripheral surface projection 103. The expression "slides over" refers to the fact that the peak portion of the outer peripheral surface projection 114 passes over the peak portion of the inner peripheral surface projection 103, and then the sidewall 102 and the projected part 116 start recovering from the deformed state.

Figure 3D:
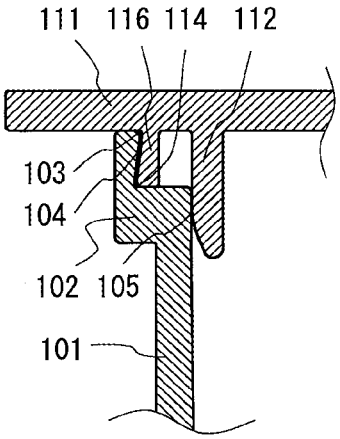
Figure 4D:
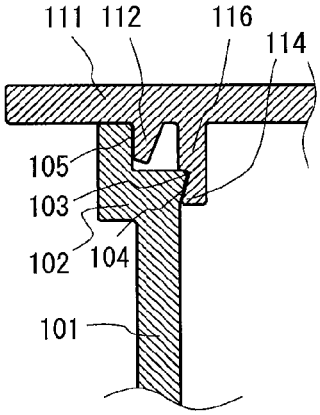
Figure 5:
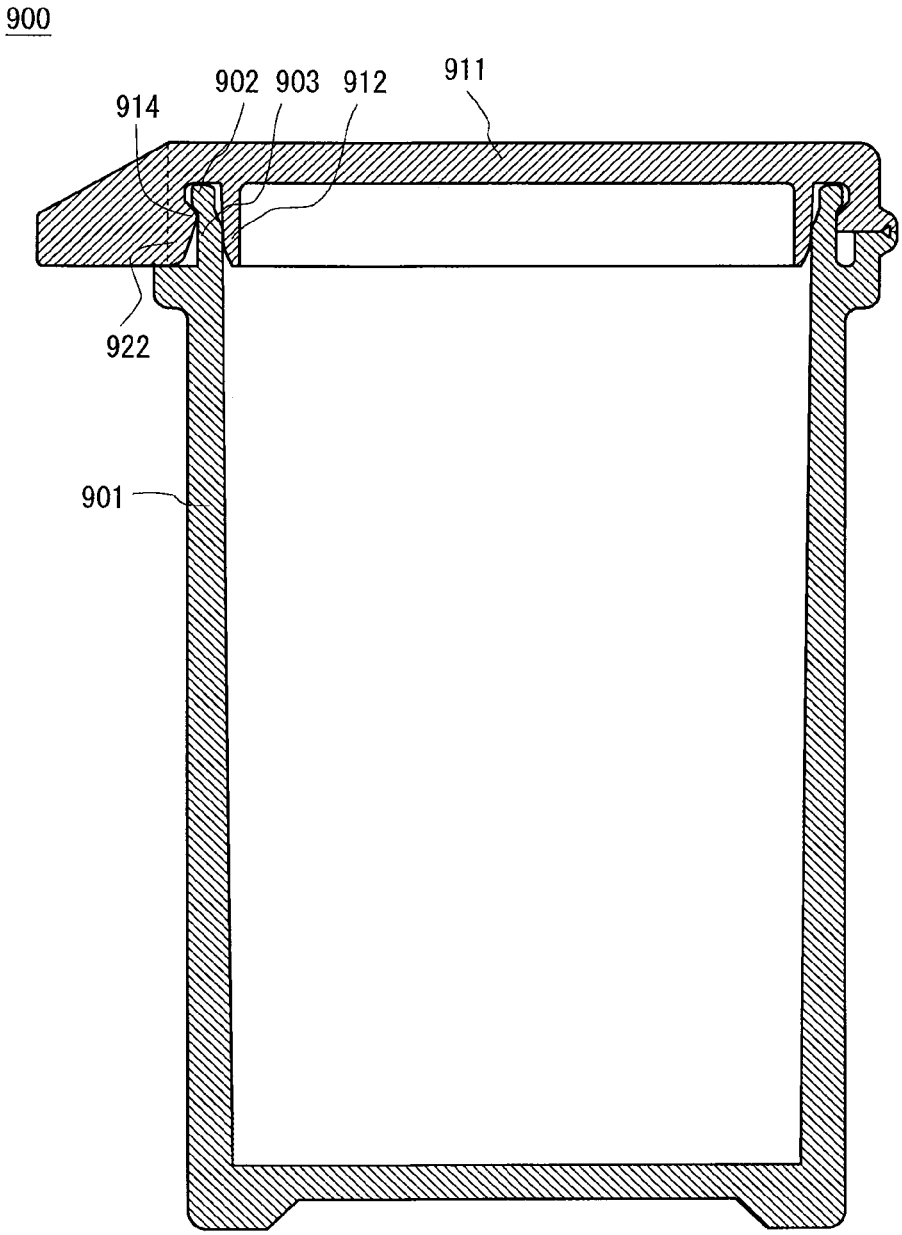
FIG. 5 PRIOR ART
FIG. 5 is a cross section of a conventional container.

Afterwards, as shown in FIG. 3D or FIG. 4D, the inner ring 112 contacts and slides over the second inner peripheral surface 105 so as to be fitted thereto to thereby seal the container body 101. At the same time, with the outer peripheral surface projection 114 and the inner peripheral surface projection 103 being engaged with each other, the lid member 111 and the container body 101 are locked to each other, and recovery from the deformed state is completed to thereby close the container body 101. In such a way, it is preferred that the container body 101 is sealed after the outer peripheral surface projection 114 slides over the inner peripheral surface projection 103. This is because the amount of the fitting that continues after completion of the sealing can be made small, and the inner pressure of the container body 100 is unlikely to rise. However, not being limited to this, the timing for the outer peripheral surface projection 114 and the inner ring 112 to contact the sidewall 102, and the timing for the inner ring 112 to conduct sealing may be different from what is described above. It is preferred that there is a gap of approximately 0.02 mm in the engaged portion in the closed state.

When the lid member 111 is opened from the closed state using the hinge 121 as an axis, a process reverse of the process described above is taken. Specifically, from the state shown in FIG. 3D or FIG. 4D, the inner ring 112 slides over and becomes separated from the second inner peripheral surface 105 (FIG. 3C), and then, the peak portion of the outer peripheral surface projection 114 slides over the peak portion of the inner peripheral surface projection 103 (FIGS. 3A-3B, 4A-4B), with the sidewall 102, the inner ring 112 and the projected part 116 elastically deformed. Further, the outer peripheral surface projection 114 is separated from the inner peripheral surface projection 103, exposing the opening portion of the container body 101, to thereby open the container body 101. The same applies to other examples shown in FIGS. 2B-2C.

In the container 100, when closing the lid member 111, the lid member 111 contacts the sidewall 102 of the container body 101, via the projected part 116 and the inner ring 112, from inside the sidewall 102. The lid member 111 does not cover the outer peripheral surface of the sidewall 102 of the container body 101.

Therefore, at least either one of the projected part 116 and the inner ring 112 favorably functions as a guide for adjusting position, making it easier to align the central axes of the lid member 111 and the container body 101 with each other towards the closed state. On the way to the closed state, since the sidewall 102 is expanded radially outward, the friction is reduced in between the projected part 116 or the inner ring 112 and the sidewall 102. As shown specifically in FIG. 2B, when the length of the projected part 116 from the top surface 113 to the outer peripheral surface projection 114 is not less than the predetermined length, the outer peripheral surface projection 114 can be easily deformed, and can softly slide over the inner peripheral surface projection 113. For these reasons, resistance that would be caused by unnecessary interference between the lid member 111 and the container body 101 can be prevented from occurring, thereby enabling stable opening/closing motion with a small force. Accordingly, by increasing the contact area of the inner ring 112 with the second inner peripheral surface 105 of the sidewall 102, the sealing performance can be improved. Further, the flange 115 can be made small. Also, the lid member 111 can also be closed by depressing the center of the top surface 113.

In addition, since the top surface 113 of the lid member 111 is in contact with the sidewall 102 of the container body 101 in a closed state, the closed state can be directly and visually confirmed. Thus, insufficient closing can be prevented because the insufficiency of the closing operation can be immediately detected by at least confirming floating of the lid member 111 from the container body 101 due to partial non-contact of the top surface 113 with the sidewall 102.

By allowing the lid member 111 and the end portion of the sidewall 102 of the container body 101 to have the same outer diameter, the planar top surface 113 can cover at least the opening portion of the container body 101, providing a fine look to the container and improves design. By aligning the side surfaces so that the peripheral edge of the lid member 111 does not protrude, undesired opening of the lid member 111 is prevented, which would otherwise occur by the impact of dropping locally working on the lid member 111.

Since the air easily escapes during closing motion of the lid member 111, the inner pressure inside the container is more unlikely to rise, and the lid member 111 is more unlikely to float in the closed state. Therefore, the closed state is more stably maintained.

By providing a shape in which the upper surface of the flange 115 is flush with the upper surface of the top surface 113, the push-down surface of the flange 115 is prevented from hanging over the sidewall 102 of the container body 101. Thus, the stroke of pushing up/down the flange 115 at the time of opening/closing the container is reduced.

As described above, in the container having the lid member connected to the container body by a hinge according to the present invention, closing operation of the lid member can be conducted more easily and reliably, while improving the design. The features mentioned above may be omitted or modified as appropriate. Also, it is understood that the embodiments discussed above are representative of the present invention, and that the present invention is not necessarily limited to these representative embodiments.

INDUSTRIAL APPLICABILITY

The present invention is useful as a container that includes a container body and a lid member sealing an opening portion of the container body. Specifically, the present invention is useful as a container for accommodating pharmaceutical products, reagents and sensors such as for blood glucose level, and the like where high sealability and repetitive opening/closing are required.

REFERENCE SIGNS LIST

100 Container
101 Container body
102 Sidewall
103 Inner peripheral surface projection
104 First inner peripheral surface
105 Second inner peripheral surface
111 Lid member
112 Inner ring
113 Top surface
114 Outer peripheral surface projection
115 Flange
116 Projection
121 Hinge

What is claimed is:

1. A container comprising a cylindrical container body, and a lid member coupled to the container body by a hinge so as to be openable/closable relative to an opening portion of the container body, wherein the lid member includes a top surface;

an inner ring formed on the top surface; and a projected part which is formed on the top surface concentrically with the inner ring, and which has an outer peripheral surface provided with an outer peripheral surface projection along a circumferential direction;

wherein the container body has a sidewall provided with a first upper portion having a first inner peripheral surface with an inner peripheral surface projection formed along the circumferential direction; and a second upper portion terminating in an upper edge and having a second inner peripheral surface with an inner diameter different from that of the first inner peripheral surface;

wherein the first upper portion extending radially outwardly from and upwardly above the upper edge of the second upper portion;

wherein when the lid member is in a closed state, the inner ring seals the container body by being fitted to the second inner peripheral surface of the container body;

wherein when closing the lid member, the outer peripheral surface projection of the projected part contacts and slides over the inner peripheral surface projection of the first inner peripheral surface while deflecting the first upper portion outwardly, to cause the lid member to be locked to the container body, as the inner ring comes into sealing contact with the second inner peripheral surface of the second upper portion;

such that when the lid member is in a closed state, contact between the outer peripheral surface projection and the inner peripheral surface is spaced above and radially outwardly of the sealing contact between the inner ring and the second inner peripheral surface.

2. The container body of claim 1, wherein:

when closing the lid member, the projected part contacts and slides over a part of the first inner peripheral surface, the projected part being a part where the inner diameter becomes large, and then an end of the inner ring causes the inner ring to seal the container body.

3. The container of claim 1, wherein:

the lid member and an end portion of the sidewall of the container body have the same outer diameter, and in a closed state, the top surface of the lid member comes into contact with the end portion of the sidewall of the container body.

4. The container of claim 1, wherein:

the lid member has a peripheral edge portion facing a portion where the lid member is coupled to the hinge, the peripheral edge portion being formed with a flange having an upper surface flush with an upper surface of the top surface of the lid member.

5. The container of claim 1, wherein when the lid member is moved from an open state to a closed state, the lid member contacts the sidewall of the container body via the projected part and the inner ring at an interior surface of the sidewall of the container body, and the lid member does not cover an outer peripheral surface of the sidewall of the container body.

6. The container of claim 1, wherein when closing the lid member via the hinge, the outer peripheral surface projection contacts the inner peripheral surface projection at a same time that the inner ring contacts the second inner peripheral surface.

* * * * *